United States Patent [19]

Zebrowski et al.

[11] Patent Number: 4,669,732

[45] Date of Patent: Jun. 2, 1987

[54] LOTTERY NUMBER SELECTOR

[76] Inventors: David Zebrowski; George Spector, both of 233 Broadway RM 3615, both of New York, N.Y. 10007

[21] Appl. No.: 748,163

[22] Filed: Jun. 24, 1985

[51] Int. Cl.[4] ..... A63F 1/10

[52] U.S. Cl. ..... 273/148 A; 116/225; 211/53; 273/293

[58] Field of Search ..... 273/148 A, 292, 293; 211/53, 58; 116/225

[56] References Cited

U.S. PATENT DOCUMENTS 1,484,564 2/1924 Riffert ..... 273/292
3,185,482 5/1965 Russell ..... 273/148 A
4,591,162 5/1986 Fakhoury ..... 273/303

FOREIGN PATENT DOCUMENTS 390763 8/1965 Switzerland ..... 273/142 HA

*Primary Examiner*—Anton O. Oechsle

[57] ABSTRACT

A lottery number selector is provided and consists of a set of numbered cards so that a series of numbers can be selected at random for a state lottery drawing. A dispenser device can be used to hold at least one set of randomly mixed numbered cards so that a person can remove the top cards one at a time. The dispenser device is rotatable about its base and has a mechanism for recording the numbers selected when each card is removed.

2 Claims, 5 Drawing Figures

LOTTERY NUMBER SELECTOR

BACKGROUND OF THE INVENTION

The instant invention relates generally to card games and more specifically it relates to a lottery number selector so that numbers can be selected at random.

Numerous card games have been provided in prior art that are adapted to utilize numbers in the play of the game. For example, U.S. Pat. Nos. 1,323,986; 4,428,582 and 4,462,597 all are illustrative of such prior art. While these units may be suitable for the particular purpose to which they address, they would not be as suitable for the purposes of the present invention as heretofore described.

SUMMARY OF THE INVENTION

A principle object of the present invention is to provide a lottery number selector that utilizes a set of numbered cards so that a series of numbers can be selected at random for a state lottery drawing.

Another object is to provide a lottery number selector that has a dispenser device which can hold at least one set of randomly mixed numbered cards so that a person can remove the top cards one at a time from the dispenser device to obtain the series of numbers for the state lottery drawing.

An additional object is to provide a lottery number selector whereby the dispenser device is rotatable about its base and has a mechanism for recording the numbers selected when each card is removed from the device.

A further object is to provide a lottery number selector that is economical in cost to manufacture.

A still further object is to provide a lottery number selector that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
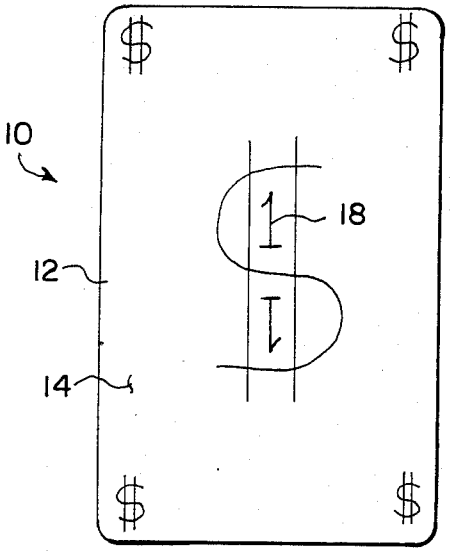
FIG. 1 is a front view of a typical lottery playing card from a set therefrom.
Figure 2:
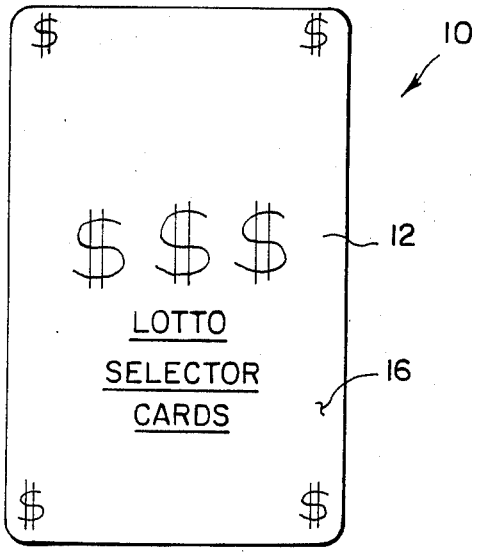
FIG. 2 is a rear view of the same typical lottery playing card.

Turning now descriptively to the drawings, in which similar reference characters denote similar elements throughout the several views, FIGS. 1 and 2 illustrates a lottery number selector 10 which consists of a set of playing pieces or cards 12 of which one typical card is shown. Each card 12 is generally flat and has a top 14 and a bottom side 16. The top side 14 bears thereupon a number 18 corresponding to one number in a state lottery drawing so that numbers can be selected at random. For example, in the case of the New York lottery, where numbers "1" through "44" are used the cards 12 can be numbered "1" through "44".

Figure 3:
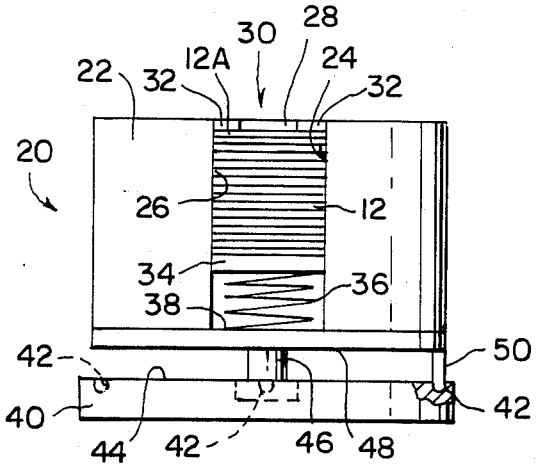
FIG. 3 is an elevational view of a dispenser device for the lottery playing cards.
Figure 4:
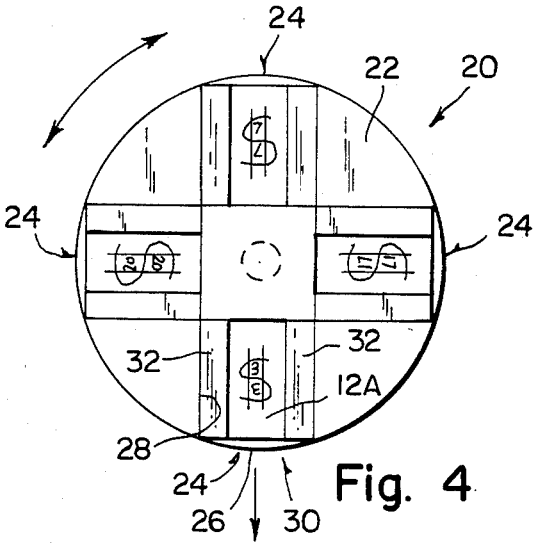
FIG. 4 is a top plan view thereof.

A dispenser device 20 is shown in FIGS. 3 and 4. The device 20 includes a housing 22 that has at least one compartment 24. The housing shown in FIG. 4 has four compartments but any number can be utilized. Since all the compartment 24 are identical only one will be described in detail.

Compartment 24 has an open front 26 and an open top 28 for holding the set of cards 12. A mechanism 30 for biasing the set of cards upwards is provided so that a person (not shown) can remove one top card 12A at a time from the compartment 24 of the housing 22 to obtain a series of numbers for the state lottery drawing.

The mechanism 30 consists of a pair of flanges 32, 32 affixed to the open top 28 of the compartment of the housing. A platform 34 for holding the set of cards 12 slideably fits within the open front 26 of the compartment 24 of the housing. A compression coil spring 36 is mounted between bottom 38 of the compartment of the housing 22 and the platform 34. The spring pushes the platform upward so that the top card 12A of the set of cards 12 will make contact with the flanges 32, 32 ready to be removed therefrom.

As best seen in FIG. 3 the dispenser device 20 further contains a base member 40 that has a plurality of radial spaced depressions 42 on upper surface 44. A rotatable shaft 46 is mounted to center of the base member 40 and affixed to center of lower surface 48 of the housing 22.

A flexible finger 50 is mounted to edge of the lower surface 48 of the housing. The finger 50 extends downwardly to engage with the depressions 42 on the upper surface of the base member. The housing 22 can be manually rotated about the base member 40 and be held by the finger 50 in a stationary position when rotation is stopped. This allows more than one person to pick from each compartment 24.

Figure 5:
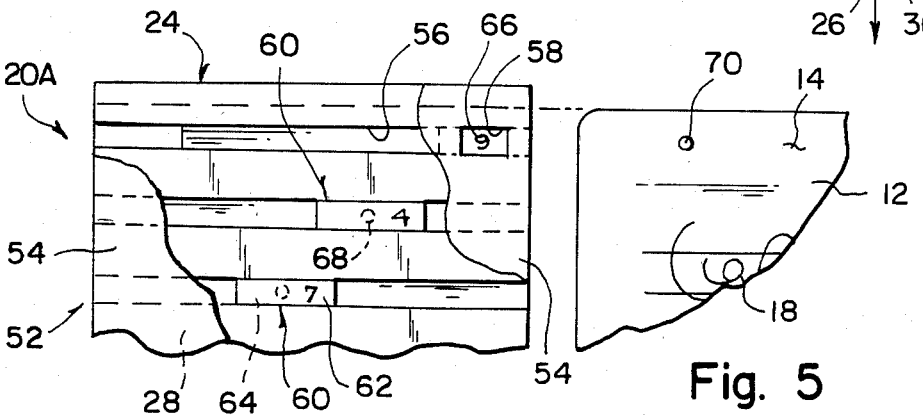
FIG. 5 is a partial top plan view of a modified dispenser device having means for recording numbers selected at random.

FIG. 5 shows a modified dispenser device 20A that further includes an apparatus 52 for recording numbers that are selected at random. The apparatus 52 consists of a cover 54 mounted over the open top 28 of the compartment 24. The cover 54 has a plurality of parallel spaced tracks 56 on its underside and a plurality of windows 58 therethrough. Each of the windows 58 are above each of the tracks 56.

A plurality of slide members 60 are also provided. Each slide member 60 has a top 62 and a bottom side 64. The top side 62 bearing thereupon a number 66 corresponding to one number 18 on one of the cards 12. The bottom side 64 has a small hole 68 therein. Each slide member 60 slides within each of the tracks 56.

Each card 12 has a small pin 70 extending upwards from the top side 14. Each pin 70 is positioned to engage within the hole 68 of the slide member 60 that has a matching number 66 with the card 12. When the top card 12 is manually pulled out of the compartment 24 the matching slide member 60 will be pulled under the corresponding window 58 so that the number 66 can be viewed through the window.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A lottery number selector which comprises a set of playing pieces, each said piece being generally flat and having a top and a bottom side, said top side bearing thereupon a number corresponding to one number in a state lottery drawing so that numbers can be selected at random, wherein said playing pieces are playing cards, further comprising a dispenser device which includes:

(a) a housing having a compartment with an open front end open top for holding said set of cards;

(b) means for biasing said set of cards upwards so that a person can removes one top card at a time from said compartment of said housing so as to obtain a series of numbers from said state lottery drawing, wherein said biasing means comprises:

(c) a pair of flanges affixed to said open top of said compartment of said housing;

(d) a platform for holding said set of cards, said platform slideably fitting within said open front of said compartment of said housing;

(e) a compression coil spring mounted between the bottom of said compartment of said housing and said platform whereby said spring pushes said platform upward so that said top card of said set of cards will make contact with said flanges ready to be removed therefrom, wherein said dispenser device further comprises:

(f) a base member having a plurality of radial spaced depressions on the upper surface;

(g) a rotatable shaft mounted to the center of said base member and affixed to the center of the lower surface of said housing; and (h) a flexible finger mounted at the edge of said lower surface of said housing, said finger extending downwardly to engage with said depression on the upper surface of said base member so that said housing can be manually rotated about said base member and be held by said finger in a stationary position when rotation is stopped, wherein said dispenser device further includes means for recording numbers that are selected at random.

2. A lottery number selector as recited in claim 1, wherein said recording means comprises:

(i) a cover mounted over said open top of said compartment, said cover having a plurality of parallel spaced tracks on its underside and a plurality of windows therethrough each of said windows above each of said tracks;

(j) a plurality of slide members, each said slide member having a top and a bottom side, said top side bearing thereupon a number corresponding to one number on one of said cards, and said bottom side having a small hole therein, each said slide member slides within each of said tracks; and (k) each said card having a small pin extending upwards from said top side, each said pin positioned to engage within said hole of said slide member having a matching number with said card so that when said top card is manually pulled out of said compartment said matching slide member will be pulled under said corresponding window so that said number can be viewed through said window.

* * * * *